US010209022B1

(12) United States Patent
Oglesby

(10) Patent No.: US 10,209,022 B1
(45) Date of Patent: Feb. 19, 2019

(54) MUZZLE DEVICE AND VENTURI BLAST SHIELD

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days.

(21) Appl. No.: 15/360,810

(22) Filed: Nov. 23, 2016

Related U.S. Application Data

(60) Provisional application No. 62/259,135, filed on Nov. 24, 2015.

(51) Int. Cl.
*F41A 21/34* (2006.01)

(52) U.S. Cl.
CPC ..... *F41A 21/34* (2013.01)

(58) Field of Classification Search
CPC ..... F41A 21/34; F41A 21/32; F41A 21/325; F41A 21/35
USPC ..... 89/14.2, 14.3, 14.4, 14.5
See application file for complete search history.

(56) References Cited

U.S. PATENT DOCUMENTS 1,555,026 A 9/1925 Rose
2,870,679 A * 1/1959 Collins ..... F41A 21/34 89/14.2
2,900,875 A 8/1959 Fergus
5,092,223 A * 3/1992 Hudson ..... F41A 21/38 89/14.2
5,433,133 A 7/1995 La France
5,596,161 A 1/1997 Sommers
6,752,062 B2 6/2004 Vais
6,837,139 B2 1/2005 Meyers
8,196,701 B1 * 6/2012 Oliver ..... F41A 21/30 181/223
8,464,625 B2 * 6/2013 Polovnev ..... F41A 21/34 89/14.2
8,695,474 B2 * 4/2014 Overbeek Bloem ..... F41A 21/325 89/14.2
9,261,319 B1 * 2/2016 Palu ..... F41A 21/34
2003/0106416 A1 6/2003 Vias
2004/0244571 A1 * 12/2004 Bender ..... F41A 21/38 89/14.3
2010/0020976 A1 * 1/2010 Ma ..... H04H 60/23 380/278
2010/0282056 A1 * 11/2010 Hung ..... F41A 21/34 89/14.2
2012/0228052 A1 * 9/2012 Findlay ..... F41A 21/30 181/223
2014/0216237 A1 * 8/2014 Butler ..... F41A 21/36 89/14.4

(Continued)

*Primary Examiner* — Joshua E Freeman
(74) *Attorney, Agent, or Firm* — Shaddock Law Group, PC

(57) ABSTRACT

A muzzle device and blast shield. The muzzle device includes a body portion having a central borehole, and wherein the body portion comprises a plurality of prongs defined between longitudinally extending slots formed in the body portion and porting apertures, wherein the porting apertures provide fluid communication between an exterior of the muzzle device and at least one longitudinally extending slot. The blast shield includes a body portion having a central borehole, wherein the body portion comprises a couple portion having an internal cavity, a barrel extension portion extending into at least a portion of the internal cavity, and a plurality of porting apertures, wherein the porting apertures provide fluid communication between an exterior of the blast shield and the internal cavity.

15 Claims, 18 Drawing Sheets

(56) References Cited

U.S. PATENT DOCUMENTS

| | | | | |
|---|---|---|---|---|
| 2015/0013204 | A1* | 1/2015 | McNitt | F41A 21/32<br>42/90 |
| 2015/0192379 | A1* | 7/2015 | Larson, Jr. | F41A 3/66<br>89/14.3 |
| 2015/0308775 | A1* | 10/2015 | Packard | F41A 21/34<br>89/14.2 |
| 2016/0091269 | A1* | 3/2016 | Miller, III | F41A 21/36<br>89/14.3 |
| 2017/0067711 | A1* | 3/2017 | Slack | F41A 21/30 |
| 2017/0191782 | A1* | 7/2017 | Bray | F41A 21/36 |
| 2017/0205175 | A1* | 7/2017 | Garst | F41A 21/30 |
| 2017/0299316 | A1* | 10/2017 | Vossler | F41A 21/34 |

* cited by examiner

MUZZLE DEVICE AND VENTURI BLAST SHIELD

CROSS-REFERENCE TO RELATED APPLICATIONS

This patent application claims the benefit of U.S. Patent Application Ser. No. 62/259,135, filed Nov. 24, 2015, the disclosure of which is incorporated herein by reference in its entirety.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, the applicant owns all trademarks and service marks identified herein.

BACKGROUND OF THE INVENTION

1. Field of the Invention

The present disclosure relates generally to the field of firearms. More specifically, the present invention relates to enhanced muzzle devices and venture blast shields for firearms.

2. Description of Related Art

A muzzle brake is a device that is attached to the terminal end of a firearm muzzle, which redirects propellant gases to counter recoil and unwanted barrel rise that normally occurs during the firing sequence.

During normal operation of a firearm, and particularly a rifle, when a round is fired, expanding gasses from the burning propellant forces the bullet through the barrel. As the bullet travels down and out of the barrel, the bullet and the propellant gases act on barrel, along the longitudinal axis, or centerline, of the barrel, to produce a recoil force. Because of the difference between the longitudinal axis of the barrel and the average point of contact between the firearm and the user (the average point where the user resists the recoil force), the muzzle end of the firearm's barrel rotates upward.

Muzzle brakes typically utilize one or more slots, vents, holes, and/or baffles to divert and/or redirect the propellant gases as they leave the barrel.

A flash suppressor, flash guard, flash eliminator, or flash hider is a device that is attached to the terminal end of a muzzle of a firearm that reduces the visible flash signature of the firearm, when it is fired, by dispersing or cooling the burning propellant gases, as they exit the muzzle of the firearm. The flash suppressor reduces the chances that the individual shooting the firearm will be temporarily blinded in lowlight shooting conditions and/or reduce the degree of muzzle flash visible to others.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

The typical flash suppressor geometry and arrangement has various shortcomings. For example, known flash suppressors do not allow for sufficient propellant gas to be cooled or disbursed prior to exiting the muzzle end of the firearm. Because of this, known flash suppressors do not produce an effective amount of muzzle flash reduction.

Thus, the features and elements of the presently disclosed muzzle devices provide various flash suppressor features and design elements that overcome the shortcomings of known flash suppressors and other muzzle devices and provide improved, muzzle devices.

The present disclosure is further directed to a blast shield that includes a venture shaped tube portion formed within the central borehole to create a pinch point that allows air to be sucked into the stream of blast or propellant gas as the gases pass through the restricted portion of the central borehole.

In various exemplary, nonlimiting embodiments, the blast shield further includes a series of rear porting holes or apertures, some of which are tapered in alternate directions and some of which comprise a constant diameter. The porting apertures, if included, allow air to be drawn into the internal cavity of the blast shield cup as propellant gases exit the muzzle device and are directed forwards.

In certain exemplary, nonlimiting embodiments, a barrel extension portion extends into at least a portion of the internal cavity of the blast shield cup. External mounting threads are provided on at least a portion of the barrel extension portion, such that a muzzle device can be fitted to the barrel extension portion.

The present disclosure is also directed to a multi-prong flash hider or muzzle device that also comprises one or more porting apertures (that may be tapered or straight) that allow propellant gases to pull or draw air through the muzzle device as the propellant gases escape out the front of the muzzle device and/or the blast shield.

In various exemplary embodiments, the porting apertures are cut or formed parallel to the central borehole or at a rearward sloping angle to the central borehole.

In certain exemplary embodiments, the central borehole of the muzzle device is tapered down, towards the prongs.

Thus, the features and elements of the presently disclosed muzzle devices provide various muzzle devices features and design elements that overcome the shortcomings of known muzzle devices and provide improved, muzzle devices.

Accordingly, the presently disclosed invention provides a muzzle device with improved muzzle flash suppression.

The presently disclosed invention separately provides a muzzle device or blast shield that allows ambient air from outside the muzzle device or blast shield to be drawn into a rear portion of the muzzle device or blast shield and into forward moving propellant gases.

The present disclosure separately provides a flash suppressor that provides improved cooling, burning, and/or disbursement of propelling gases exiting the muzzle end of a firearm.

The present disclosure separately provides a flash suppressor that can be retrofitted to an existing firearm.

The present disclosure separately provides a flash suppressor that can be easily installed by a user.

These and other aspects, features, and advantages of the present invention are described in or are apparent from the following detailed description of the exemplary, non-limiting embodiments of the present invention and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein.

Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

Any benefits, advantages, or solutions to problems that are described herein with regard to specific embodiments are not intended to be construed as a critical, required, or essential feature(s) or element(s) of the present invention or the claims.

BRIEF DESCRIPTION OF THE SEVERAL VIEWS OF THE DRAWINGS

As required, detailed embodiments of the present invention are disclosed herein. However, it is to be understood that the disclosed embodiments are merely exemplary of the invention that may be embodied in various and alternative forms. The figures are not necessarily to scale and some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of the present disclosure will be described in detail, with reference to the following figures, wherein like reference numerals refer to like parts throughout the several views, and wherein.

DETAILED DESCRIPTION OF THE INVENTION

Figure 1:
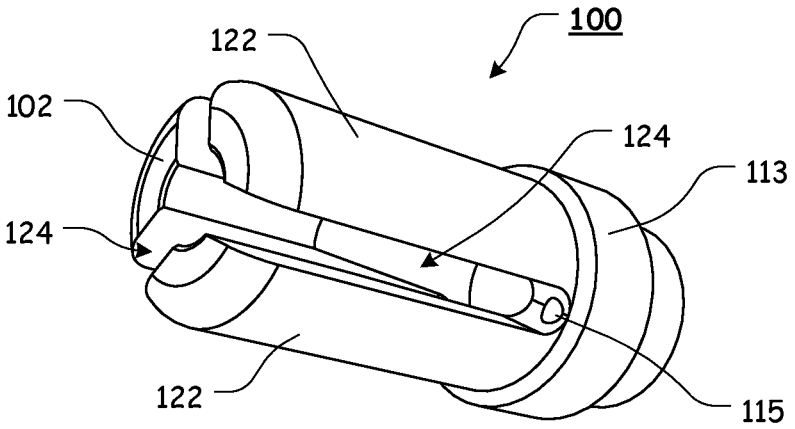
FIG. 1 shows a lower front perspective view of an exemplary embodiment of a muzzle device, according to the present disclosure.
Figure 2:
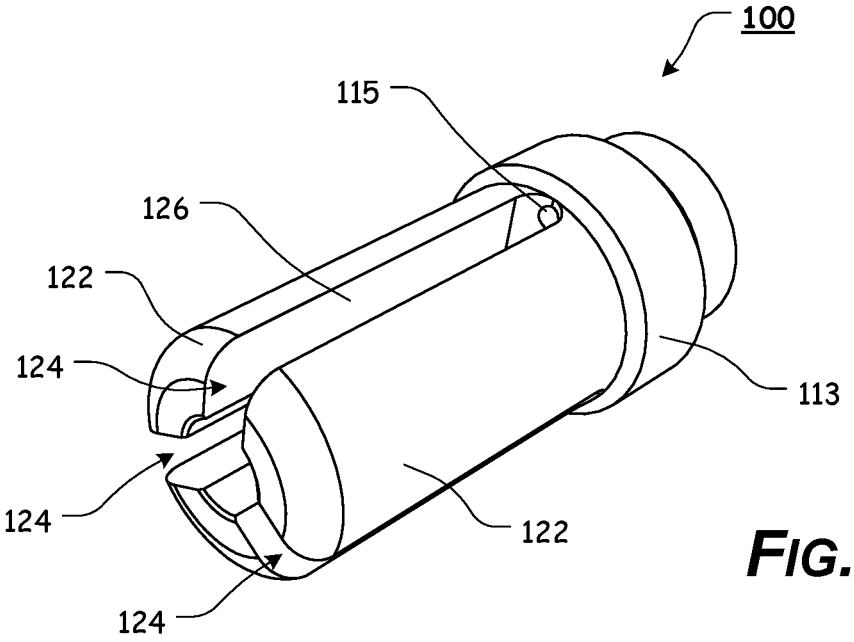
FIG. 2 shows an upper front perspective view of an exemplary embodiment of a muzzle device, according to the present disclosure.
Figure 3:
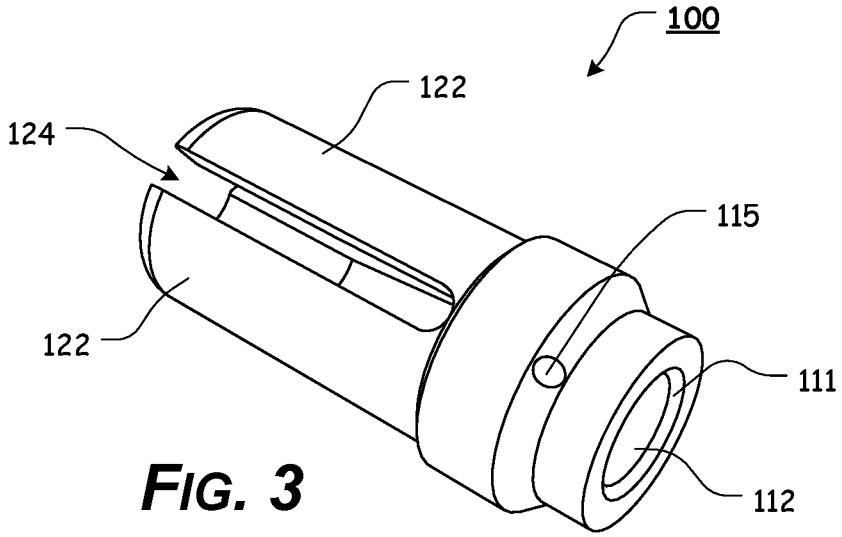
FIG. 3 shows an upper rear perspective view of an exemplary embodiment of a muzzle device, according to the present disclosure.
Figure 4:
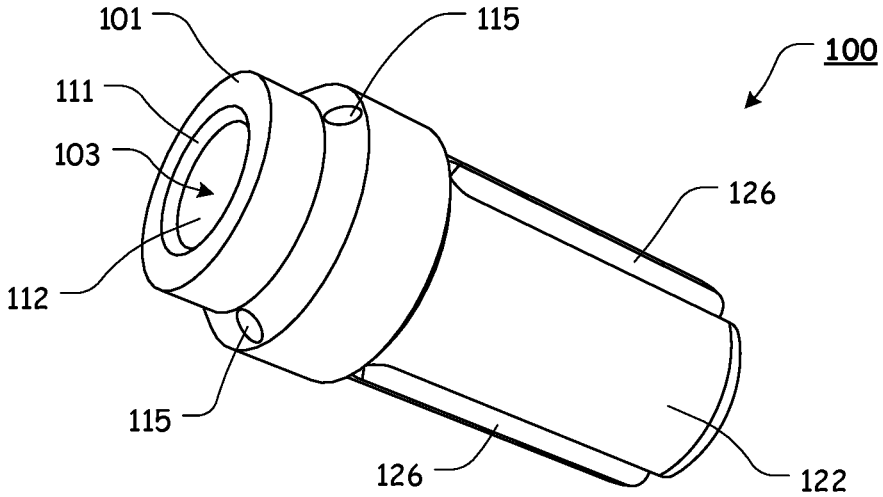
FIG. 4 shows a lower rear perspective view of an exemplary embodiment of a muzzle device, according to the present disclosure.
Figure 5:
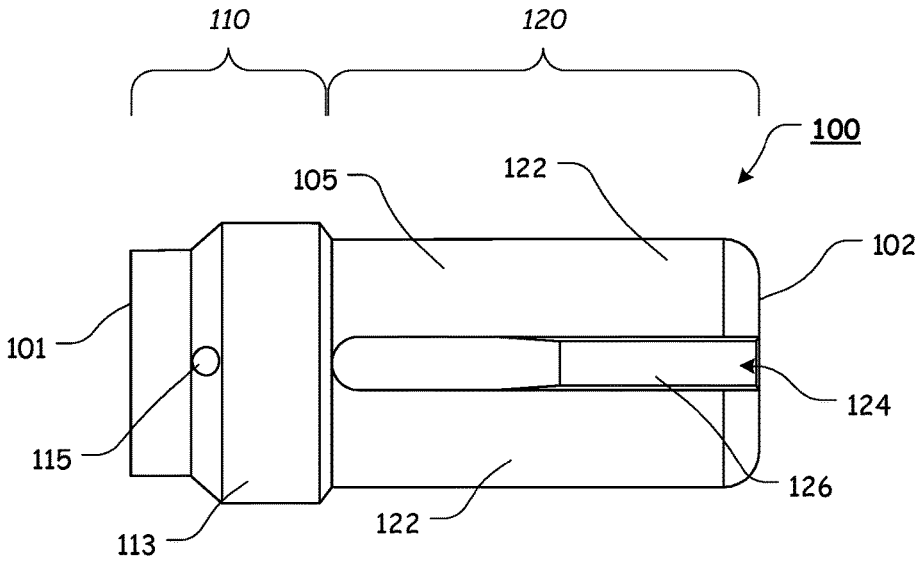
FIG. 5 shows a top plan view of an exemplary embodiment of a muzzle device, according to the present disclosure.
Figure 6:
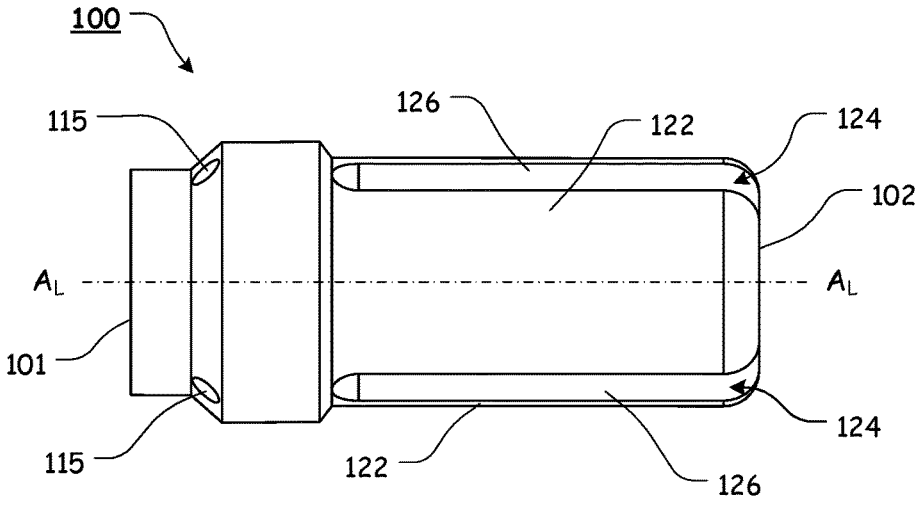
FIG. 6 shows a bottom plan view of an exemplary embodiment of a muzzle device, according to the present disclosure.
Figure 7:
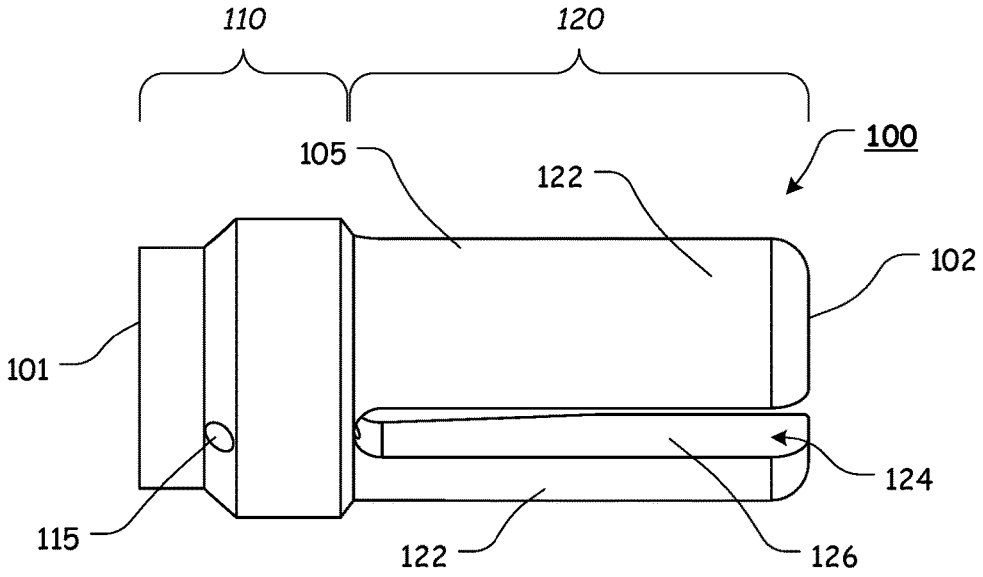
FIG. 7 shows a right side view of an exemplary embodiment of a muzzle device, according to the present disclosure.
Figure 8:
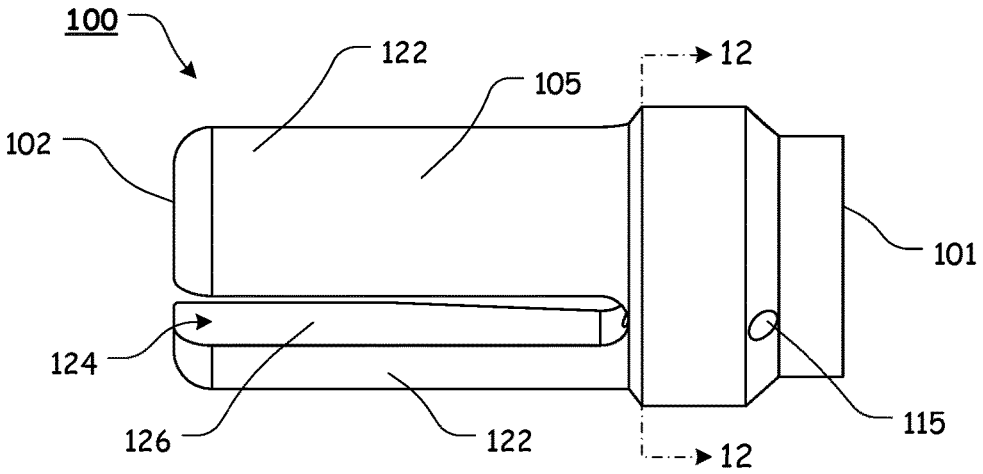
FIG. 8 shows a left side view of an exemplary embodiment of a muzzle device, according to the present disclosure.
Figure 9:
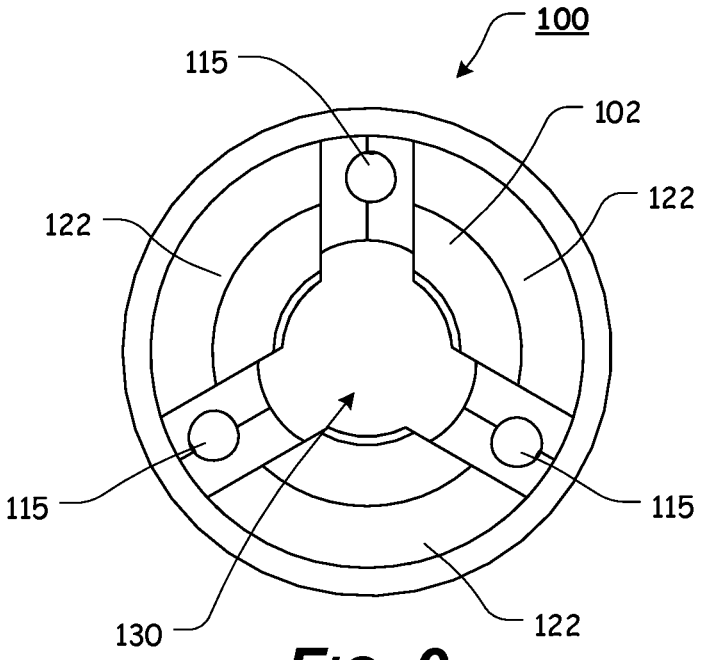
FIG. 9 shows a front view of an exemplary embodiment of a muzzle device, according to the present disclosure.
Figure 10:
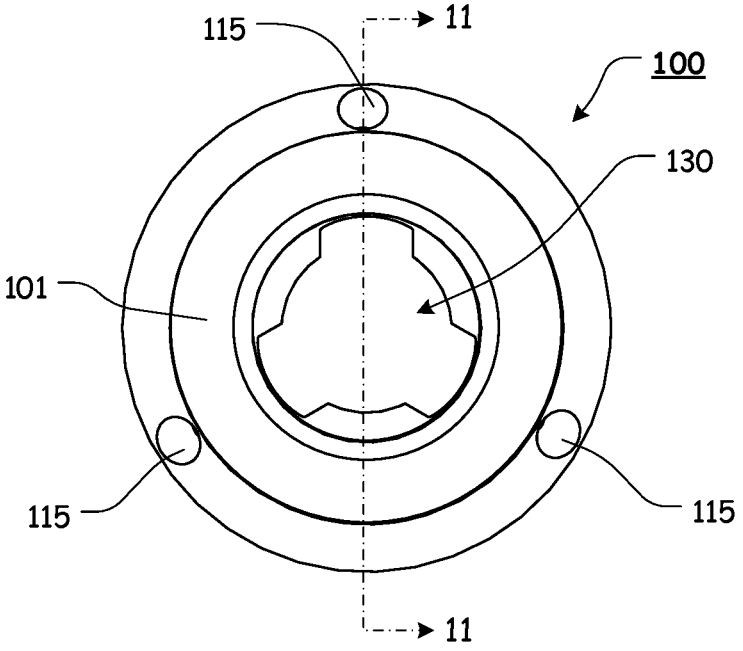
FIG. 10 shows a rear view of an exemplary embodiment of a muzzle device, according to the present disclosure.
Figure 11:
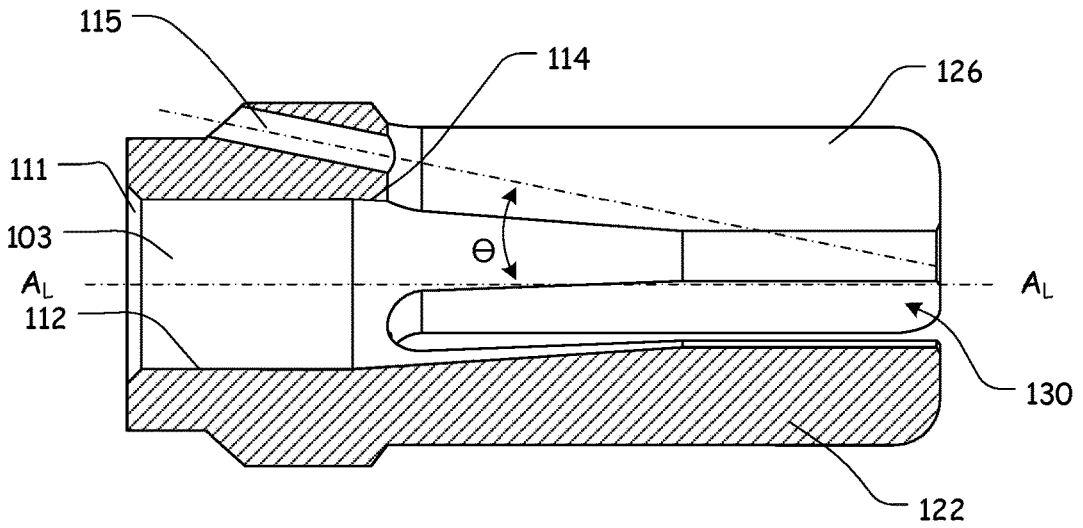
FIG. 11 shows a side cross-sectional view taken along line 11-11 of the muzzle device of FIG. 10, illustrating the exemplary embodiment of the muzzle device according to the present disclosure in greater detail.
Figure 12:
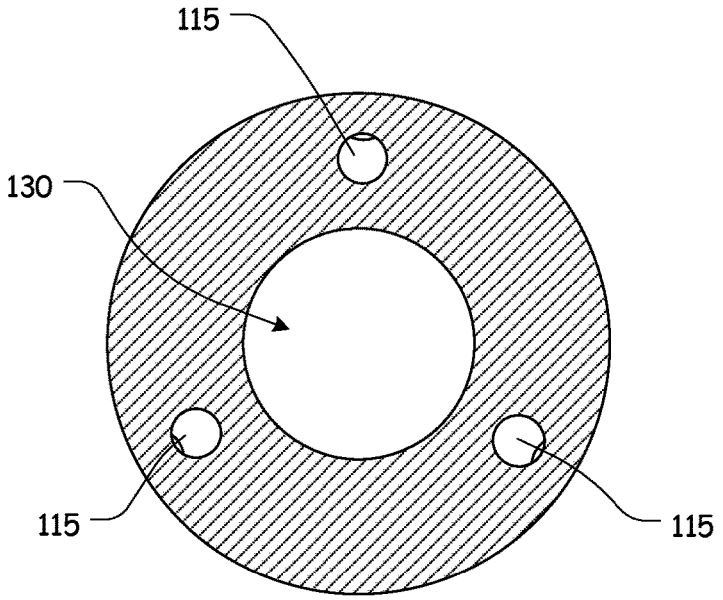
FIG. 12 shows a front cross-sectional view taken along line 12-12 of the muzzle device of FIG. 8, illustrating the exemplary embodiment of the muzzle device according to the present disclosure in greater detail.
Figure 13:
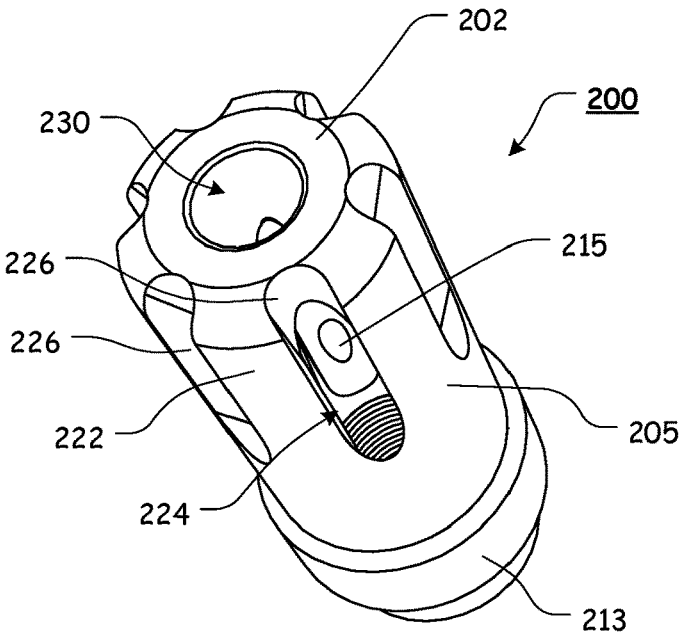
FIG. 13 shows a lower front perspective view of an exemplary embodiment of a muzzle device, according to the present disclosure.
Figure 14:
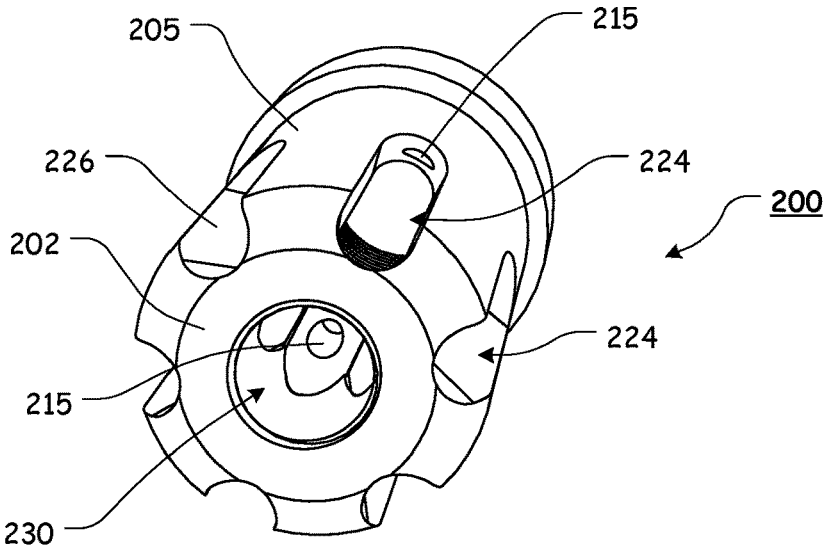
FIG. 14 shows an upper front perspective view of an exemplary embodiment of a muzzle device, according to the present disclosure.
Figure 15:
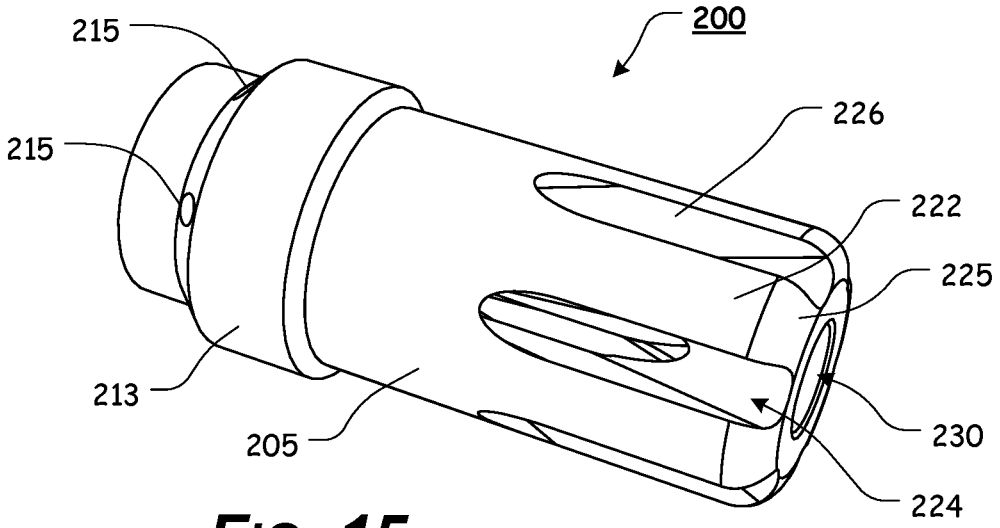
FIG. 15 shows an upper front perspective view of an exemplary embodiment of a muzzle device, according to the present disclosure.
Figure 16:
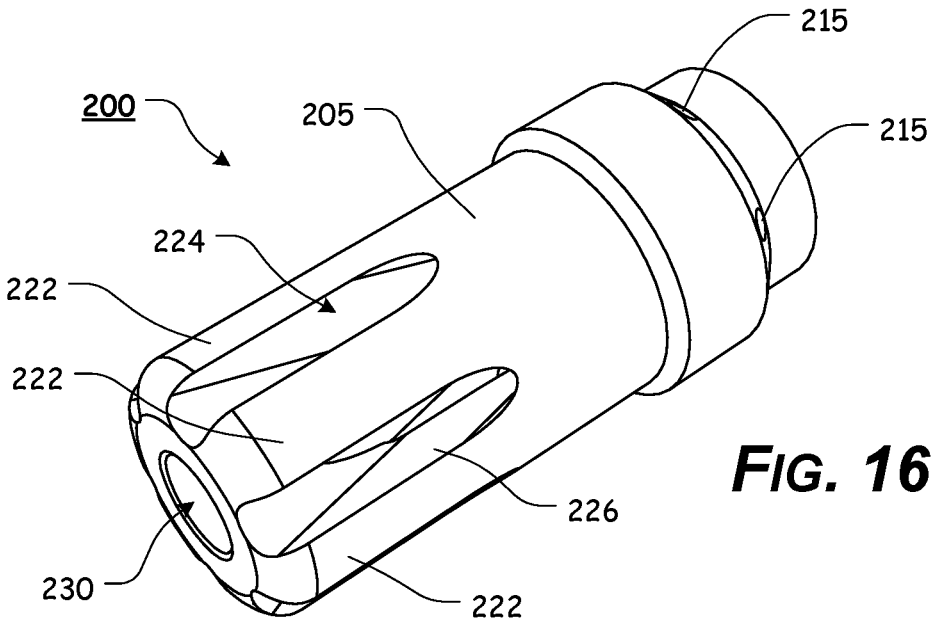
FIG. 16 shows a upper front perspective view of an exemplary embodiment of a muzzle device, according to the present disclosure.
Figure 17:
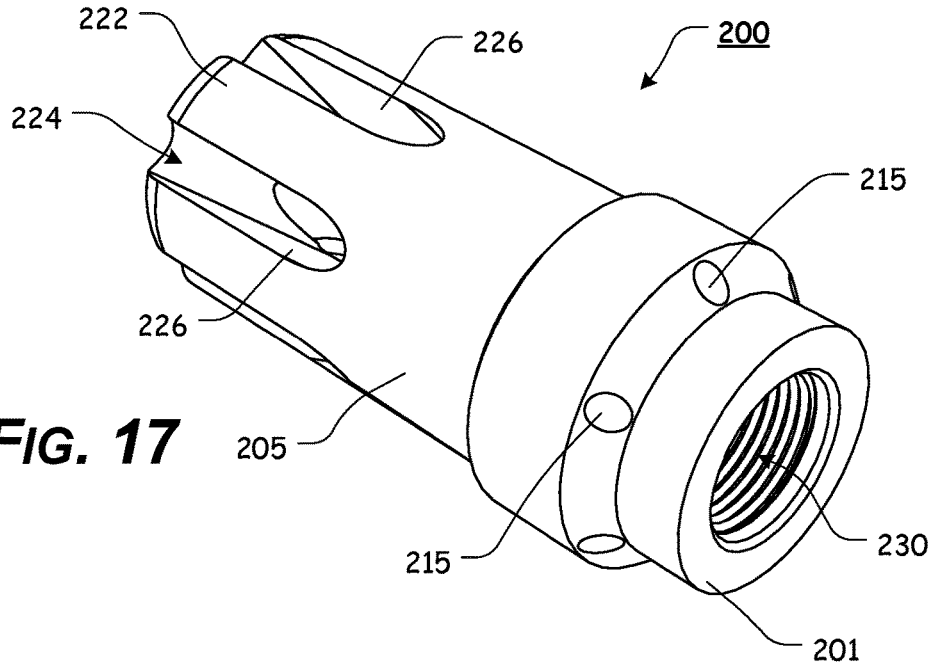
FIG. 17 shows an upper rear perspective view of an exemplary embodiment of a muzzle device, according to the present disclosure.
Figure 18:
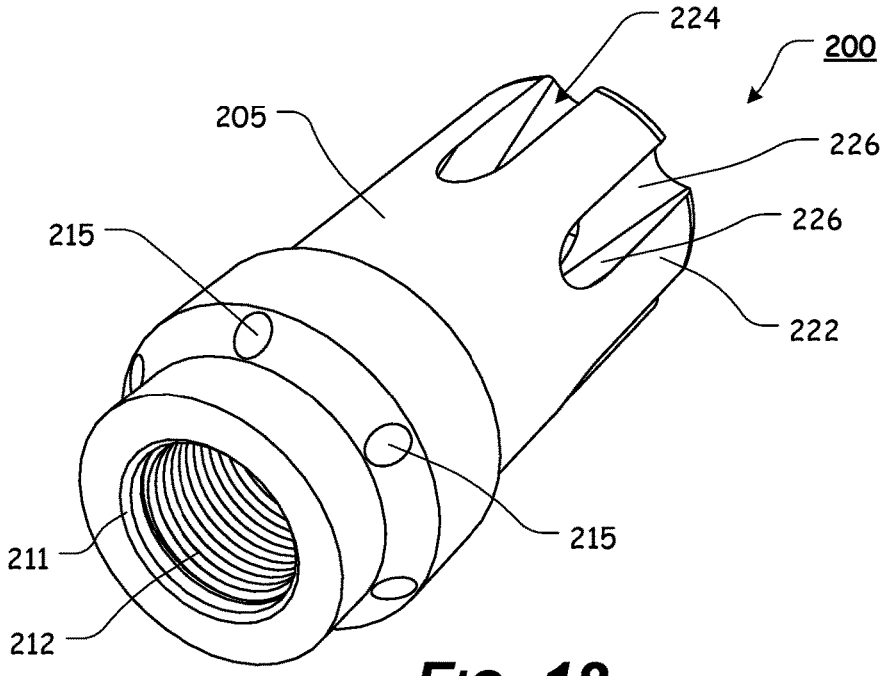
FIG. 18 shows a upper rear perspective view of an exemplary embodiment of a muzzle device, according to the present disclosure.
Figure 19:
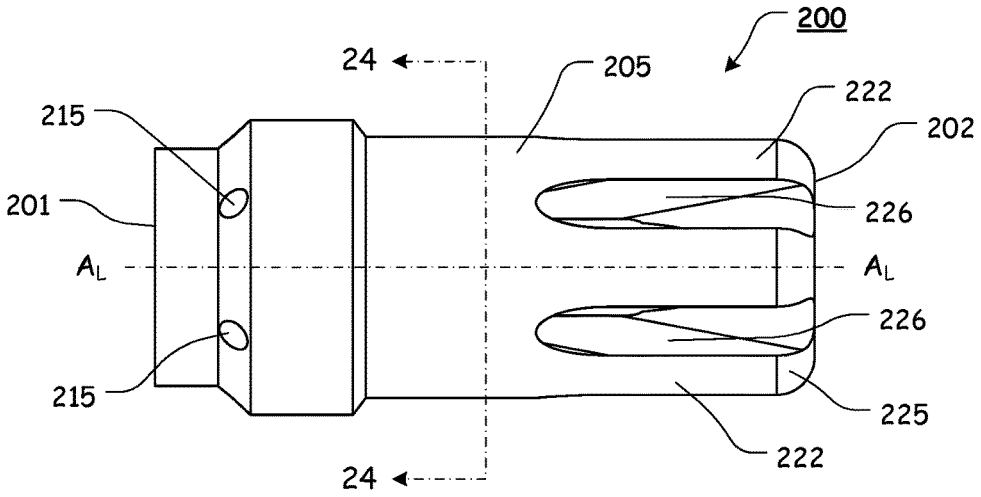
FIG. 19 shows a right side plan view of an exemplary embodiment of a muzzle device, according to the present disclosure (it being appreciated that the left side plan view is a mirror image of the right side plan view)
Figure 20:
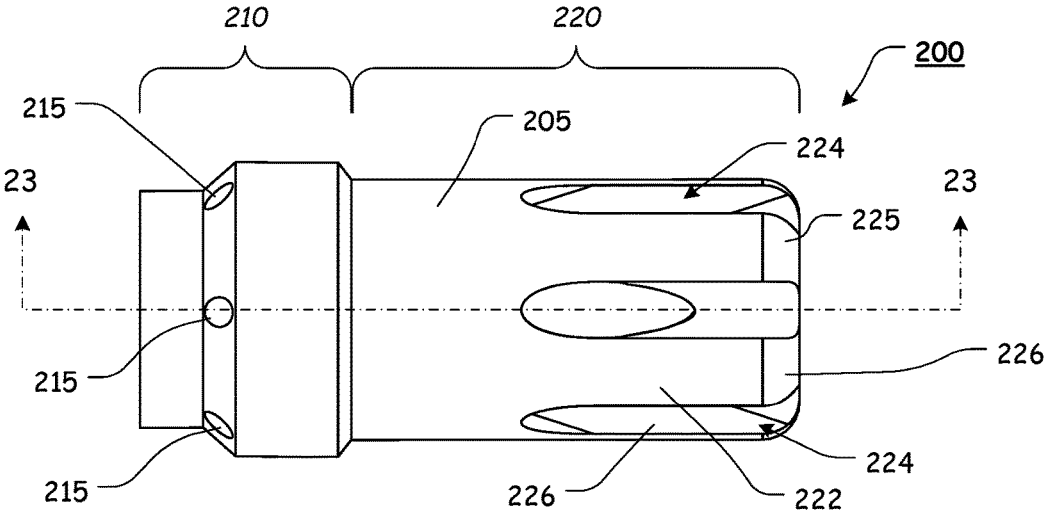
FIG. 20 shows a top plan view of an exemplary embodiment of a muzzle device, according to the present disclosure (it being appreciated that the bottom plan view is a mirror image of the top plan view)
Figure 21:
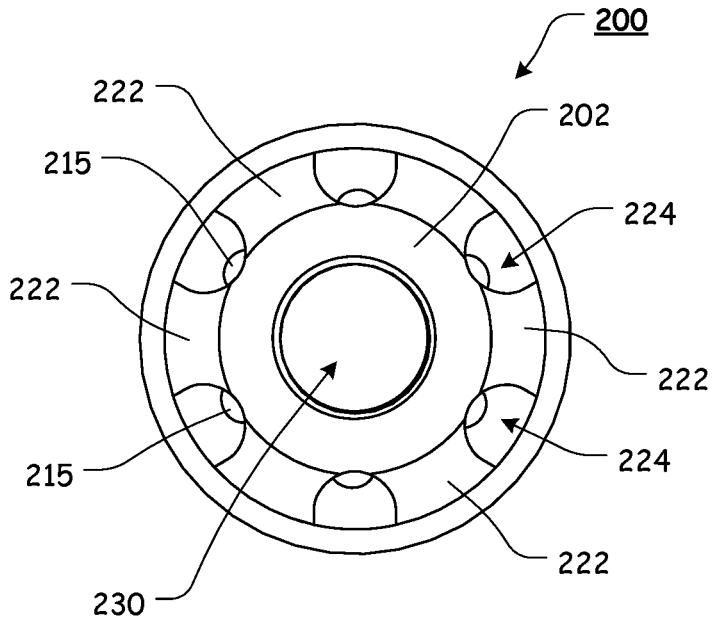
FIG. 21 shows a front view of an exemplary embodiment of a muzzle device, according to the present disclosure.
Figure 22:
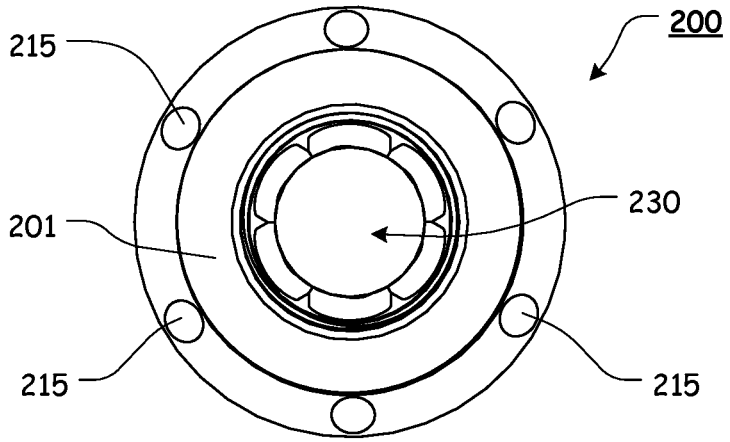
FIG. 22 shows a rear view of an exemplary embodiment of a muzzle device, according to the present disclosure.
Figure 23:
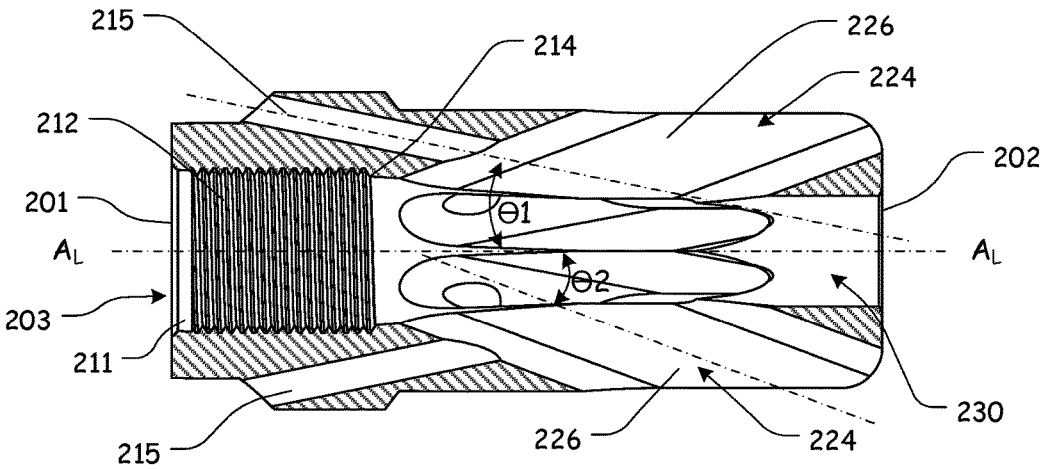
FIG. 23 shows a side cross-sectional view taken along line 23-23 of the muzzle device of FIG. 20, illustrating the exemplary embodiment of the muzzle device according to the present disclosure in greater detail.
Figure 24:
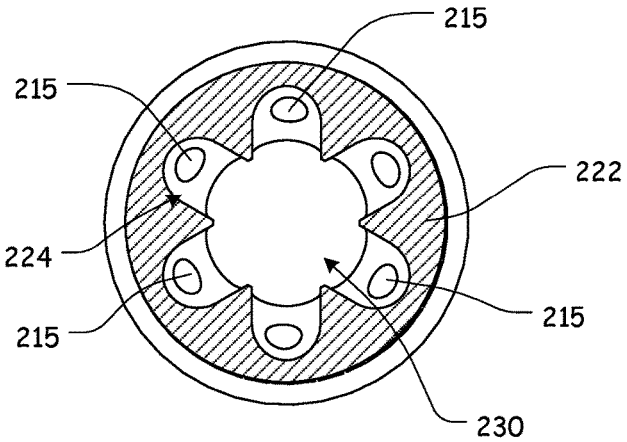
FIG. 24 shows a front cross-sectional view taken along line 24-24 of the muzzle device of FIG. 19, illustrating the exemplary embodiment of the muzzle device according to the present disclosure in greater detail.
Figure 25:
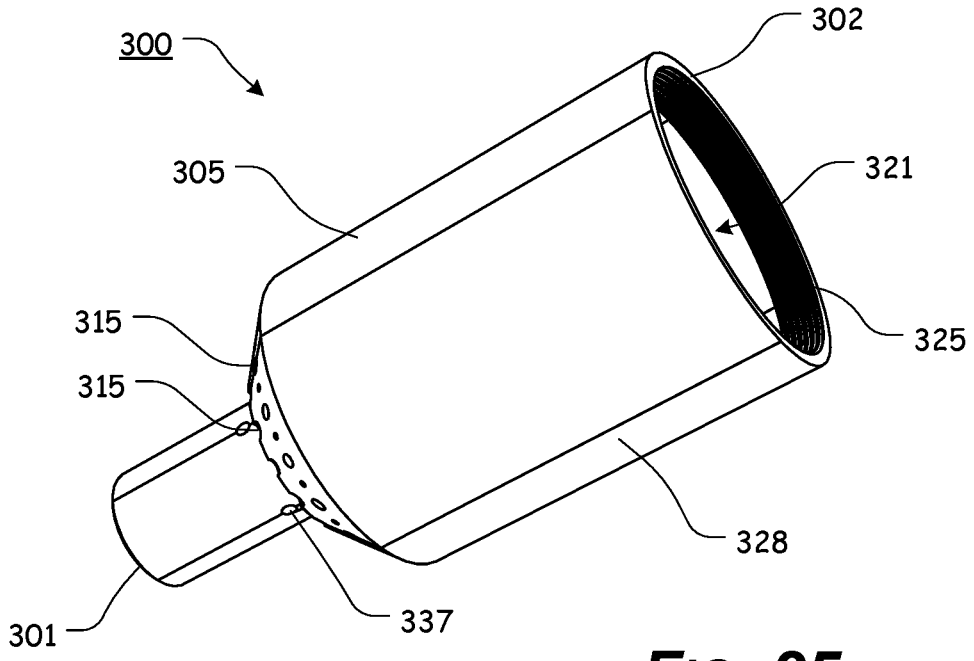
FIG. 25 shows a perspective view of an exemplary embodiment of a blast shield, according to the present disclosure.
Figure 26:
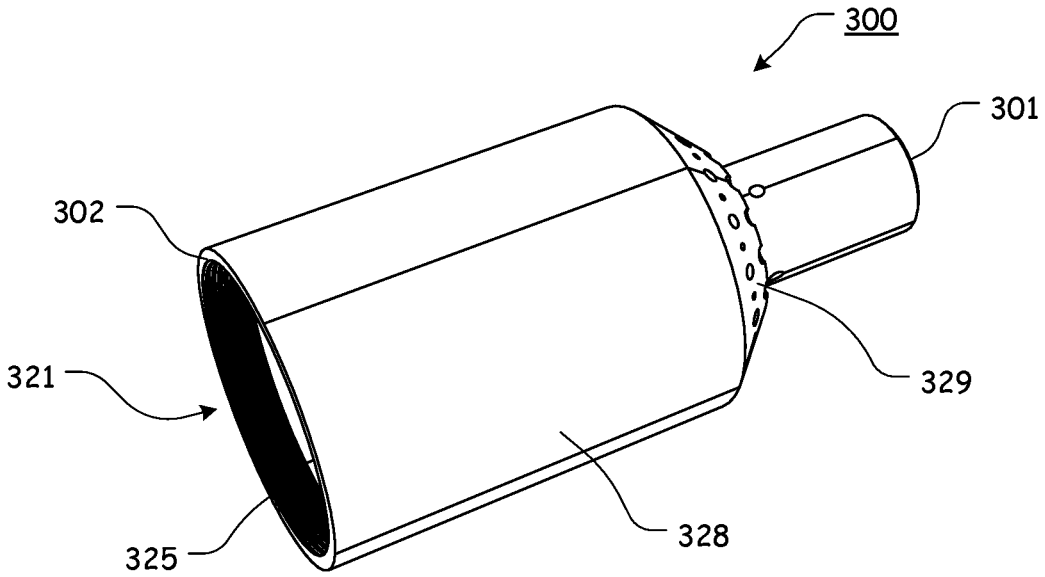
FIG. 26 shows a perspective view of an exemplary embodiment of a blast shield, according to the present disclosure.
Figure 27:
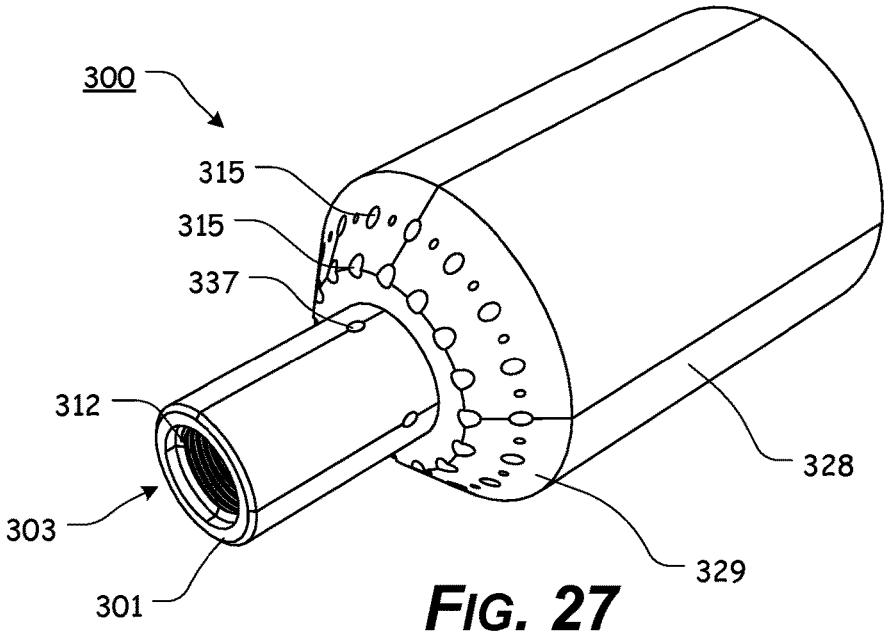
FIG. 27 shows an upper rear perspective view of an exemplary embodiment of a blast shield, according to the present disclosure.
Figure 28:
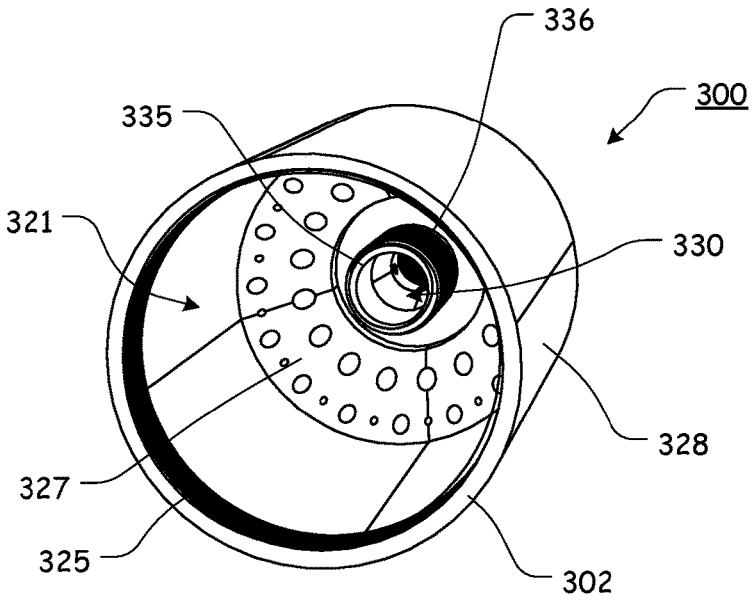
FIG. 28 shows an upper front perspective view of an exemplary embodiment of a blast shield, according to the present disclosure.
Figure 29:
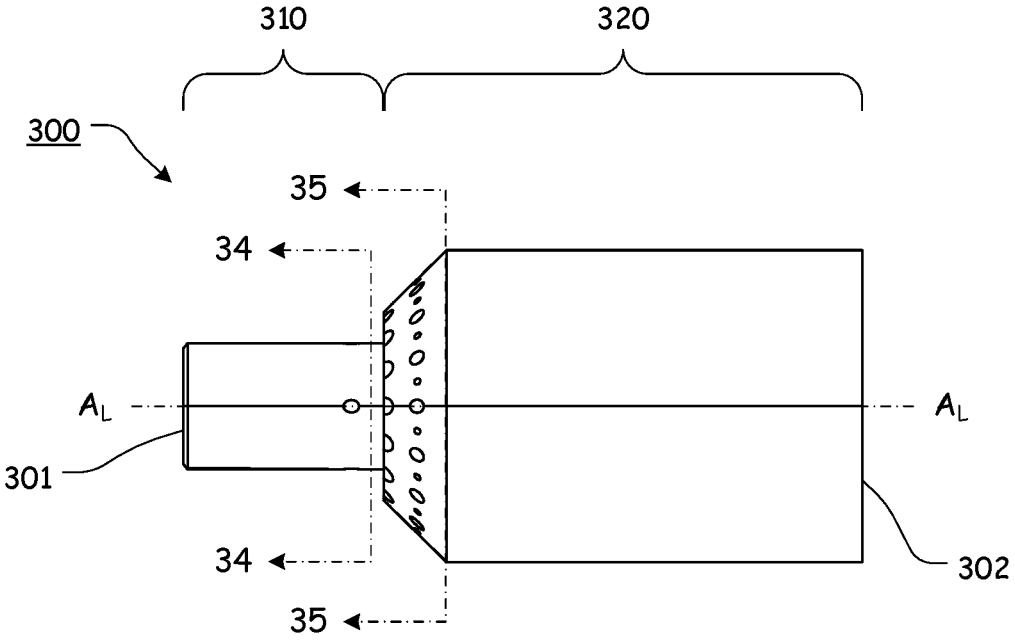
FIG. 29 shows a side plan view of an exemplary embodiment of a blast shield, according to the present disclosure.
Figure 30:
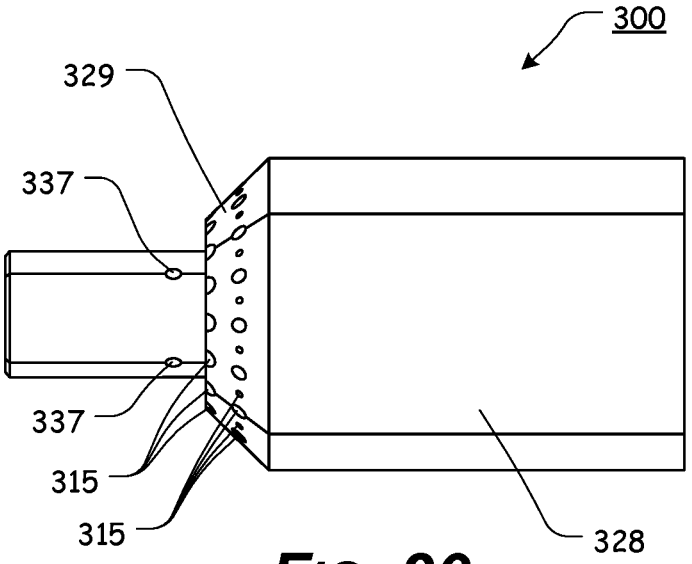
FIG. 30 shows a side plan view of an exemplary embodiment of a blast shield, according to the present disclosure.
Figure 31:
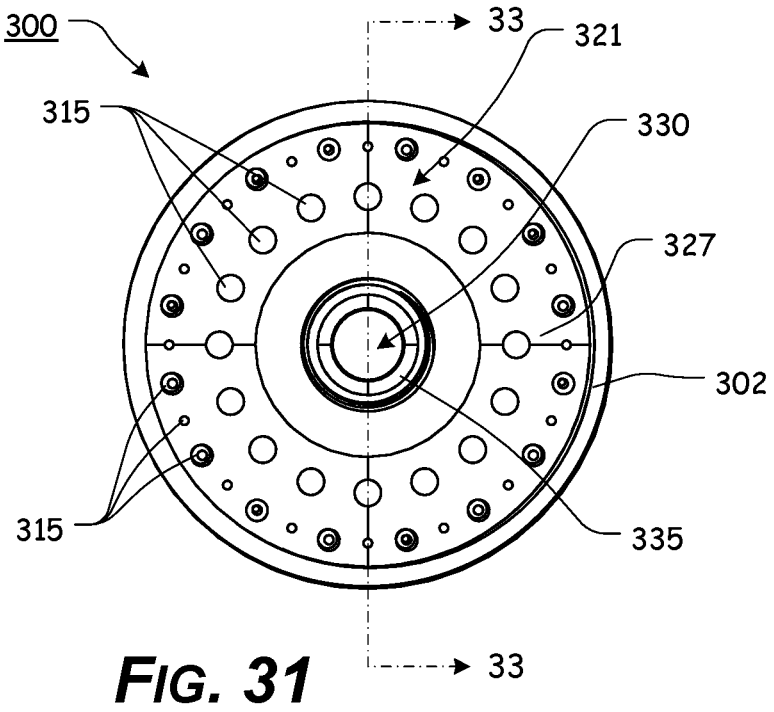
FIG. 31 shows a front view of an exemplary embodiment of a blast shield, according to the present disclosure.
Figure 32:
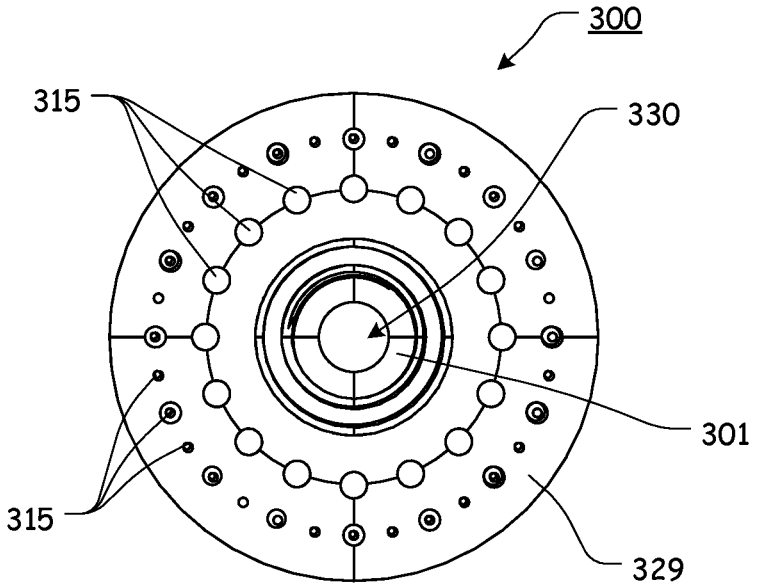
FIG. 32 shows a rear view of an exemplary embodiment of a blast shield, according to the present disclosure.
Figure 33:
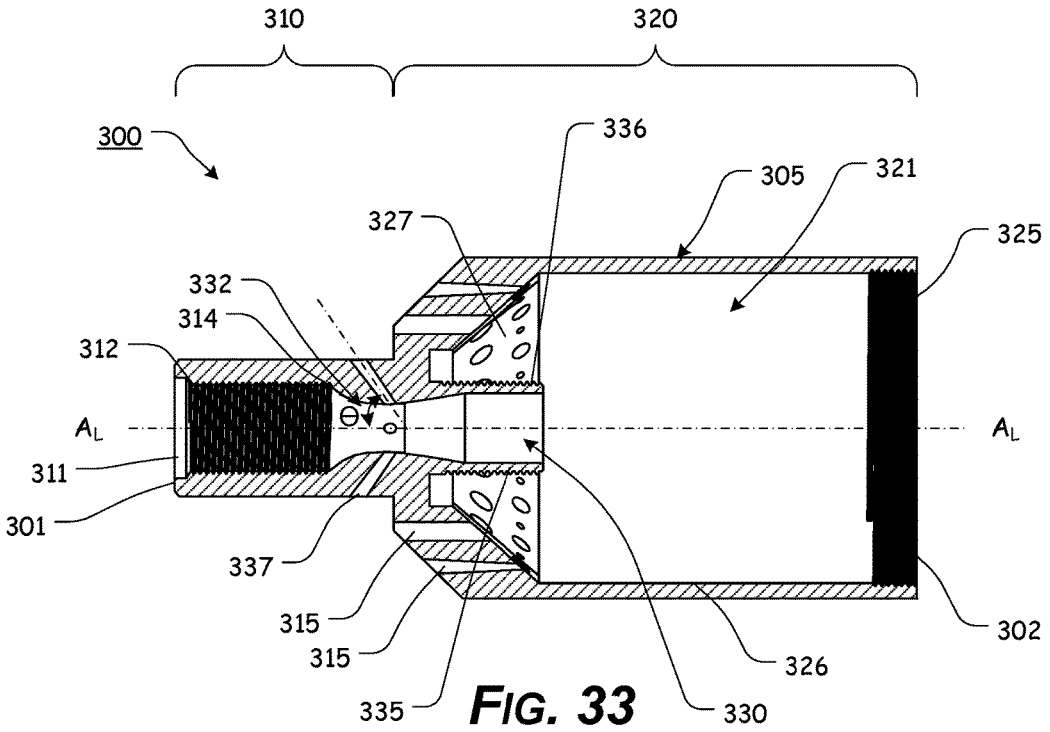
FIG. 33 shows a side cross-sectional view taken along line 33-33 of the blast shield of FIG. 31, illustrating the exemplary embodiment of the blast shield according to the present disclosure in greater detail.
Figure 34:
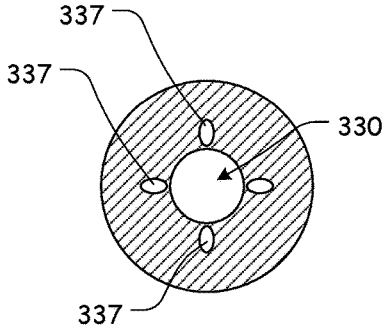
FIG. 34 shows a front cross-sectional view taken along line 34-34 of the blast shield of FIG. 29, illustrating the exemplary embodiment of the blast shield according to the present disclosure in greater detail.
Figure 35:
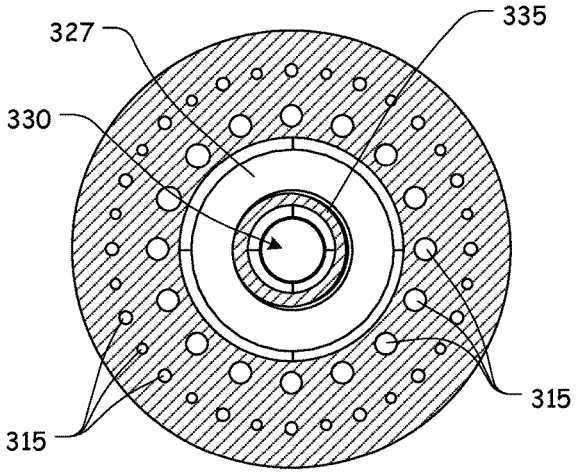
FIG. 35 shows a front cross-sectional view taken along line 34-34 of the blast shield of FIG. 29, illustrating the exemplary embodiment of the blast shield according to the present disclosure in greater detail.

For simplicity and clarification, the design factors and operating principles of the muzzle device and/or blast shield according to the present disclosure are explained with reference to various exemplary embodiments of a muzzle device and/or blast shield according to the present disclosure. The basic explanation of the design factors and operating principles of the muzzle device and/or blast shield is applicable for the understanding, design, and operation of the muzzle delays and/or blast shield of the present disclosure. It should be appreciated that the muzzle device and/or blast shield can be adapted to many applications where a muzzle device and/or blast shield can be used (either individually or in combination).

It should also be appreciated that the terms "firearm", "muzzle device", and "blast shield" are used for basic explanation and understanding of the operation of the systems, methods, and apparatuses of the present disclosure. Therefore, the terms "firearm", "muzzle device", and "blast shield" are not to be construed as limiting the systems, methods, and apparatuses of the present disclosure.

For simplicity and clarification, the various embodiments of the muzzle devices and/or blast shields of the present disclosure will be described as being used in connection with a rifle barrel. However, it should be appreciated that these are merely exemplary embodiments of the muzzle devices and/or blast shields and are not to be construed as limiting this invention. Thus, the muzzle devices and/or blast shields of the present disclosure may be utilized in connection with any rifle, pistol, artillery piece, firearm, or other device.

Throughout this application the word "comprise", or variations such as "comprises" or "comprising" are used. It will be understood that these terms are meant to imply the inclusion of a stated element, integer, step, or group of elements, integers, or steps, but not the exclusion of any other element, integer, step, or group of elements, integers, or steps.

Turning now to the drawing FIGS., FIGS. 1-12 illustrate certain elements and/or aspects of an exemplary embodiment of a flash suppressor or muzzle device 100, according to the present disclosure. In certain illustrative, non-limiting embodiments of the present disclosure, as illustrated in FIGS. 1-12, the muzzle device 100 comprises at least some of a muzzle device body or body portion 105 that extends from an attachment portion 110 to a suppression portion 120.

The body portion 105 comprises an elongate portion of substantially cylindrical material that extends, along a longitudinal axis, $A_L$, from an initial end 101 to a terminal end 102. In certain exemplary embodiments, various components of the muzzle device 100, including the body portion 105, are formed of steel. Alternate materials of construction of the various components of the body portion 105 may include one or more of the following: stainless steel, aluminum, titanium, and/or other metals, as well as various alloys, combinations, and/or composites thereof. Thus, it should be understood that the material or materials used to form the muzzle device 100 is a design choice based on the desired appearance, strength, and functionality of the muzzle device 100.

While the body portion 105 is shown and described as being substantially cylindrical in shape, it is to be distinctly understood that the body portion 105 may comprise any shape. Thus, while a substantially cylindrical outer shape would allow for ease in manufacturing and would conform with the customary use of cylindrical shaped muzzle brakes, the shape of the body portion 105 is not limited to being substantially cylindrical and, for example, may be substantially oval, oblong, triangular, square, rectangular hexagonal, octagonal, etc.

The muzzle device 100 extends from an attachment portion 110 to a suppression portion 120. The attachment portion 110 is adapted to attach to a muzzle end of a firearm barrel (not shown) or a barrel extension portion 335 of a blast shield 300. The suppression portion 120 extends beyond the muzzle end of the firearm barrel, along a longitudinal axis $A_L$ of the muzzle device 100.

A central borehole 130 extends through the body portion 105, generally along the longitudinal axis $A_L$ of the muzzle device 100. The central borehole 130 has a central borehole 130 diameter $D_{CBA}$. Typically, the central borehole 130 diameter $D_{CBA}$ is sufficient to allow the caliber of round with which the muzzle device 100 is to be utilized to safely pass through the central borehole 130. Thus, it should be appreciated that the diameter $D_{CBA}$ of the central borehole 130 is a design choice based upon the caliber of weapon or other device with which the muzzle device 100 is to be utilized.

An internally threaded attachment recess 103, optionally having internal mounting threads 112, extends along the central borehole 130 from the initial end 101 to a recess shoulder 114. The internally threaded attachment recess 103 is adapted to receive at least a portion of a firearm barrel (not shown) or a portion of an extension portion 335 of a blast shield 300 and allow the muzzle device 100 to be threadedly attached to the barrel or blast shield 300. In various exemplary embodiments, the internal mounting threads 112 have a thread size of ½-24, a common thread size for threaded muzzle devices 100 utilized with 0.223 or 5.56 rifle barrels.

However, it should be appreciated that the thread size of the internal mounting threads 112 may be adapted to receive a portion of a barrel or barrel extension portion 335 having any desired thread size. Thus, the thread size and/or pitch of the internal mounting threads 112 is a design choice based upon the threaded barrel size of the weapon or other device with which the muzzle device 100 is to be used. Additionally, it should be appreciated that the threads may be right-hand threads or left-hand threads.

In various exemplary embodiments, the internally threaded attachment recess 103 is initiated by a transition or beveled portion 111. If included, the transition or beveled portion 111, may also allow for improved ease of threading the muzzle device 100 to a barrel or to the blast shield 300.

The muzzle device 100 is shown as having the internally threaded attachment recess 103 to allow the muzzle device 100 to be threadedly attached to the barrel of a firearm or to the blast shield 300. In certain exemplary embodiments, the attachment portion 110 of the body portion 105 may optionally be attached to the barrel or to the blast shield 300 by any suitable means, including, for example, clamps, quick-release connectors, or any other known or later developed attachment device. Thus, it should be understood that such attachment may also be accomplished by a coupling or any other means sufficient to attach or couple the muzzle device 100 to the muzzle end of a firearm or to the blast shield 300, including those typical in the prior art. In still other exemplary embodiments, the muzzle device 100 (and the disclosed muzzle device 100 assembly) may be substantially permanently affixed to the muzzle of a firearm or to the blast shield 300.

Thus, the attachment portion 110 of the body portion 105 contains a means for attaching the muzzle device 100 to a muzzle end of a firearm barrel or to the blast shield 300, while the suppression portion 120 of the body portion 105 is adapted to discharge a projectile though the central borehole 130.

To aid in the installation of the muzzle device 100, parallel flats (not shown) may be provided on either side of the body portion 105, proximate the initial end 101. The flats (not shown) provide parallel surfaces for a wrench or other installation device to grip the muzzle device 100.

One or more partially-circumferentially or circumferential attachment grooves or extensions may be formed in the attachment portion 110 for securing additional devices (not shown) to the muzzle device 100.

The suppression portion 120 of the muzzle device 100 includes one or more longitudinally extending slots 124 that form or define sidewalls 126 of forwardly extending elongated members or prongs 122. Each prong 122 is offset from and separated from each adjacent prong 122 by a longitudinally extending slot 124. In certain exemplary embodiments, the sidewalls 126 extend from an outer surface of the body portion 105 to a radiused or partially radiused portion that is proximate to and at least partially defines the central borehole 130. In various exemplary embodiments, the apexes of adjacent sidewalls 126 are proximate to and at least partially define the central borehole 130. In various exemplary embodiments, a centerline of one or more of the slots 124 may optionally be offset from a bisecting centerline of the body portion 105.

In certain exemplary, nonlimiting embodiments, the width of each slot 124 is at least partially tapered, such that each slot 124 is wider proximate the central borehole 130 and more narrow proximate the outer surface. By tapering the width of each slot 124, when a projectile is discharged through the central bore propellant gases are forced outwards and forwards as the propellant gases are discharged through the central borehole 130, thereby dispersing the propellant gases radially away from the central borehole 130. This increases turbulence and mixing of more air with the propellant or blast gasses, thus reducing flash further. Alternatively, the width of each slot 124 may be consistent or may be more narrow proximate the central borehole 130 and widen proximate the outer surface.

In certain exemplary, nonlimiting embodiments, as illustrated in FIGS. 1-12, the suppression portion 120 includes three slots 124 defining three prongs 122. However, it should be appreciated that the suppression portion 120 may comprise a greater or lesser number of slots 124 and prongs 122. Thus, the number of slots 124 and prongs 122 is a design choice based upon the desired functionality and/or appearance of the muzzle device 100.

In various exemplary embodiments, at least one collar or collar portion 113 extends from the body portion 105 and provides a circumferential expansion of the body portion 105. Depending upon the amount of material present in the body portion 105 of the muzzle device 100, the collar or collar portion 113 may not be present.

In certain exemplary embodiments, the collar or collar portion 113 is formed within the attachment portion 110 of the muzzle device 100. Alternatively, the collar or collar portion 113 may optionally be formed in the suppression portion 120 or partially within the attachment portion 110 and partially within the suppression portion 120.

One or more porting apertures 115 are formed between an outer surface of the body portion 105 and the central borehole 130. In various exemplary embodiments, at least one porting aperture 115 is formed between an outer surface of the body portion 105 and a portion of the sidewall 126 of each slot 124 formed between each prong 122. As illustrated most clearly in FIG. 11, each porting aperture 115 may optionally be formed at an angle $\Theta$ relative to the longitudinal axis $A_L$ of the muzzle device 100. In certain exemplary embodiments, each porting aperture 115 is formed at the same angle $\Theta$ relative to the longitudinal axis $A_L$ of the muzzle device 100. Alternatively, various porting apertures 115 may be formed at various angles $\Theta$ relative to the longitudinal axis $A_L$ of the muzzle device 100.

As illustrated, the porting apertures 115 have substantially parallel sidewalls 126 and have a substantially cylindrical shape. Alternatively, one or more of the porting apertures 115 may be tapered or reversed tapered, having a more conical shape.

The porting apertures 115 are formed so as to allow fluid communication between the exterior of the muzzle device 100 (typically a rear portion of the muzzle device 100), the central borehole 130 of the suppression portion 120, and at least one longitudinally extending slot 124 of the suppression portion 120. Thus, the one or more porting apertures 115 allow fluid communication between the central borehole 130 and at least a portion of a slot 124 and the outside surface of the muzzle device 100.

The porting apertures 115 allow for fluid communication from the exterior of the muzzle device 100, through the porting apertures 115, even if the initial end 101 of the muzzle device 100 is flush against a shoulder of a firearm muzzle or another surface. Thus, air is able to enter from the outer surface of the muzzle device 100, through the porting apertures 115, and travel along the porting apertures 115, through the collar 113 (if included) and exit through the central borehole 130 or one of the plurality of slots 124.

If the porting apertures 115 are formed in the collar or collar portion 113, other elements, such as crush washers or timing shims, can still be used without obstructing the flow of air through the porting apertures 115 and porting apertures 115.

The inclusion of the porting apertures 115 provides a Venturi effect to draw relatively cooler air in, proximate the initial end 101 of the muzzle device 100, and mix the relatively cooler intake air with propellant gas. Thus, "extra" air from the exterior of the muzzle device 100 can be mixed with the propellant gases as they flow through the central borehole 130 and the slots 124. In various exemplary embodiments, this acts to reduce muzzle flash signature.

The overall length, angle, diameter, size, shape, and depth of each porting aperture 115 is a design choice based upon the desired functionality (i.e. fluid capacity, fluid flow characteristics, etc.) of the muzzle device 100.

Thus, during use of the muzzle device 100, as a round exits the muzzle of the firearm, the round travels through the central borehole 130. The propellant gases propelling the round enter the central borehole 130 and, utilizing the Venturi effect, pull ambient, outside air through the porting apertures 115 to mix with the propellant gases. As the propellant gases continue to move through the central borehole 130, a portion of the propellant gases flow through the slots 124. The portions of the propellant gases flowing through the slots 124 are further cooled as they travel outwardly, through the slots 124, and into the surrounding, ambient air. A remaining portion of the propellant gases then continues to flow outward from the central borehole 130 into the ambient air.

FIGS. 13-24 illustrate certain elements and/or aspects of an exemplary embodiment of a muzzle device 200, according to the present disclosure. As illustrated in FIGS. 13-24, the muzzle device 200 includes at least some of a body or body portion 205 extending from an initial end 201 to a terminal end 202 and having an attachment portion 210 and a suppression portion 220. The muzzle device 200 further includes an internally threaded attachment recess 203, a central borehole 230, internal mounting threads 212, a transition or beveled portion 211, an optional collar 213, slots 224 defining prongs 222, and porting apertures 215.

It should be understood that each of these elements corresponds to and operates similarly to the body or body portion 105, the attachment portion 110, the suppression portion 120, the initial end 101, the terminal end 102, the internally threaded attachment recess 103, the central borehole 130, the internal mounting threads 112, the transition or beveled portion 111, the optional collar 113, the slots 124, the prongs 122, and the porting apertures 115, as described above with reference to the muzzle device 100 of FIGS. 1-12.

However, as illustrated in FIGS. 13-24, the muzzle device 200 further comprises a crown portion 225 formed so as to further define the slots 224 and join portions of the prongs 222 proximate the terminal end 202 of the muzzle device 200. The crown portion 225 further defines the central borehole 230 proximate the terminal end 202 of the muzzle device 200.

Furthermore, the muzzle device 200, as illustrated in FIGS. 13-24, includes six slots 224 defining six prongs 222. A porting aperture 215 is associated with each slot 224. Thus, six porting apertures 215 are defined at spaced apart locations of the muzzle device 200.

While the suppression portion 220 includes six slots 224 defining six prongs 222, it should be appreciated that the suppression portion 220 may comprise a greater or lesser number of slots 224 and prongs 222. Thus, the number of slots 224 and prongs 222 is a design choice based upon the desired functionality and/or appearance of the muzzle device 200.

One or more porting apertures 215 are formed between an outer surface of the body portion 205 and the central borehole 230. In various exemplary embodiments, at least one porting aperture 215 is formed between an outer surface of the body portion 205 and a portion of the sidewall 226 of each slot 224 formed between each prong 222. As illustrated most clearly in FIG. 23, each porting aperture 215 may optionally be formed at an angle Θ1 relative to the longitudinal axis $A_L$ of the muzzle device 200. In certain exemplary embodiments, each porting aperture 215 is formed at the same angle Θ1 relative to the longitudinal axis $A_L$ of the muzzle device 200. Alternatively, various porting apertures 215 may be formed at various angles Θ1 relative to the longitudinal axis $A_L$ of the muzzle device 200.

As illustrated, the porting apertures 215 have substantially parallel sidewalls 226 and have a substantially cylindrical shape. Alternatively, one or more of the porting apertures 215 may be tapered or reversed tapered, having a more conical shape.

The porting apertures 215 are formed so as to allow fluid communication between the exterior of the muzzle device 200 (typically a rear portion of the muzzle device 200), the central borehole 230 of the suppression portion 220, and at least one longitudinally extending slot 224 of the suppression portion 220. Thus, the one or more porting apertures 215 allow fluid communication between the central borehole 230 and at least a portion of a slot 224 and the outside surface of the muzzle device 200.

As further illustrated, the crown portion 225 further defines each of the slots 224. Thus, as illustrated most clearly in FIG. 23, each slot 224 may optionally be formed at an angle Θ2 relative to the longitudinal axis $A_L$ of the muzzle device 200. In certain exemplary embodiments, each slot 224 is formed at the same angle Θ2 relative to the longitudinal axis $A_L$ of the muzzle device 200. Alternatively, various slots 224 may be formed at various angles Θ2 relative to the longitudinal axis $A_L$ of the muzzle device 200.

It should be appreciated that, while in use, the elements of the muzzle device 200 illustrated in FIGS. 13-24 operate substantially similarly to the similar elements of the muzzle device 100 illustrated in FIGS. 1-12.

FIGS. 25-35 illustrate certain elements and/or aspects of an exemplary embodiment of a blast shield 300 to optionally be used in conjunction with a muzzle device, such as, for example, the muzzle devices 100 or 200 of the present disclosure. However, it should be appreciated that the blast shield 300 may be utilized without a muzzle device.

As illustrated, the blast shield 300 comprises a body or body portion 305 comprising an elongate portion of material that extends along a longitudinal axis $A_L$ from an open initial end 301 to an open terminal end 302. The body portion 305 comprises an attachment portion 310 and a blast cup portion 320.

In certain exemplary embodiments, various components of the blast shield 300, including the body portion 305, are formed of steel. Alternate materials of construction of the various components of the blast shield 300 may include one or more of the following: stainless steel, aluminum, titanium, and/or other metals, as well as various alloys, combinations, and/or composites thereof. Thus, it should be understood that the material or materials used to form the blast shield 300 is a design choice based on the desired appearance, strength, and functionality of the blast shield 300.

While the attachment portion 310 and the blast cup portion 320 are shown and described as being substantially cylindrical in shape, it is to be distinctly understood that the attachment portion 310 and the blast cup portion 320 may comprise any shape. Thus, while a substantially cylindrical outer shape would allow for ease in manufacturing and would conform with the customary use of cylindrical shaped muzzle brakes, the shape of the blast shield 300 (and the attachment portion 310 and/or blast cup portion 320) is not limited to being substantially cylindrical and, for example, may be substantially oval, oblong, triangular, square, rectangular hexagonal, octagonal, etc.

The blast shield 300 extends from the attachment portion 310 that is adapted to attach to a muzzle end of a firearm barrel (not shown) to a blast cup portion 320 that extends beyond the muzzle end of the firearm barrel, along a longitudinal axis $A_L$ of the blast shield 300.

An internally threaded attachment recess 303, having internal mounting threads 312, extends along the central borehole 330 from the initial end 301 to a recess shoulder 314. The internally threaded attachment recess 303 is adapted to receive at least a portion of a firearm barrel (not shown) or a blast shield 300 and allow the blast shield 300 to be threadedly attached to the barrel or blast shield 300. In various exemplary embodiments, the internal mounting threads 312 have a thread size of ½-24, a common thread size utilized with 0.223 or 5.56 rifle barrels. However, it should be appreciated that the thread size of the internal mounting threads 312 may be adapted to receive a portion of a barrel or barrel extension portion 335 having any desired thread size. Thus, the thread size and/or pitch of the internal mounting threads 312 is a design choice based upon the threaded barrel size of the weapon or other device with which the blast shield 300 is to be used. Additionally, it should be appreciated that the threads may be right-hand threads or left-hand threads.

In various exemplary embodiments, the internally threaded attachment recess 303 is initiated by a transition or beveled portion 311. If included, the transition or beveled portion 311, may also allow for improved ease of threading the blast shield 300 to a barrel.

The blast shield 300 is shown as having the internally threaded attachment recess 303 to allow the blast shield 300 to be threadedly attached to the barrel of a firearm. In certain exemplary embodiments, the attachment portion 310 of the body portion 305 may optionally be attached to the barrel by any suitable means, including, for example, clamps, quick-release connectors, or any other known or later developed attachment device. Thus, it should be understood that such attachment may also be accomplished by a coupling or any other means sufficient to attach or couple the blast shield 300 to the muzzle end of a firearm, including those typical in the prior art. In still other exemplary embodiments, the blast shield 300 (and the disclosed blast shield 300 assembly) may be substantially permanently affixed to the muzzle of a firearm.

Thus, the attachment portion 310 of the body portion 305 contains a means for attaching the blast shield 300 to a muzzle end of a firearm barrel, while the blast cup portion 320 of the body portion 305 is adapted to discharge a projectile though the central borehole 330.

To aid in the installation of the blast shield 300, parallel flats (not shown) may be provided on either side of the body portion 305, proximate the initial end 301. The flats (not shown) provide parallel surfaces for a wrench or other installation device to grip the blast shield 300.

One or more partially-circumferentially or circumferential attachment grooves or extensions may be formed in the attachment portion 310 for securing additional devices (not shown) to the blast shield 300.

The cup portion 320 includes an internal cavity 321 defined by one or more internal cup sidewalls 326 and one or more internal cup bottom walls 327. The internal cavity 321 extends from the one or more internal cup bottom walls 327, along the one or more internal cup sidewalls 326, to an open top end that corresponds to the open terminal end 302 of the blast shield 300. In various exemplary embodiments, the internal cavity 321 is a substantially cylindrical internal cavity 321. However, it should be appreciated that the internal size, shape, and configuration of the internal cavity 321 is a design choice based upon the desired functionality and/or ornamental appearance of the blast shield 300.

It should also be appreciated that the one or more external cup sidewalls 328 may also form a substantially cylindrical outer sidewall 326 or may form a different shape. Additionally, it should also be appreciated that the form of the outer sidewalls 326 may be the same or different from the form of the internal cup sidewalls 326. For example, the exterior cup sidewalls 326 may form a substantially cylindrical outer sidewall 326, while the internal cup sidewalls 326 may take on a different shape, such as, for example, a substantially octagonal shape.

In various exemplary embodiments, a portion of the internal cup sidewalls 326 includes an internally threaded portion 325 proximate the open terminal end 302. If included, the internally threaded portion 325 provides a way for various attachments to be fitted to the blast shield 300.

One or more external cup transition walls 329 may be formed between or be a transition between a portion of the attachment portion 310 and a portion of the cup portion 320. In various exemplary embodiments, an external surface of the external cup transition wall 329 is formed at a substantially acute angle to the longitudinal axis $A_L$ of the blast shield 300. Alternatively, the external cup transition wall 329 may have a surface that is substantially perpendicular to the longitudinal axis $A_L$ of the blast shield 300.

In certain exemplary, nonlimiting embodiments, a barrel extension portion 335 extends into at least a portion of the internal cavity 321 of the cup portion 320. The barrel extension portion 335 provides an extension of the central borehole 330 into the internal cavity 321 of the cup portion 320. External mounting threads 336 are provided on at least a portion of the barrel extension portion 335, such that a muzzle device, such as, for example, a muzzle device 100 or a muzzle device 200, can be fitted to the barrel extension portion 335.

In various exemplary embodiments, the external mounting threads 336 are adapted to threadedly attach a muzzle device, such as, for example, a muzzle device 100 or a muzzle device 200, to the barrel extension portion 335. In various exemplary embodiments, the external mounting threads 336 have a thread size of ½-24, a common thread size for threaded muzzle devices 100 or 200 utilized with 0.223 or 5.56 rifle barrels. However, it should be appreciated that the thread size of the external mounting threads 336 may be adapted to receive a portion of a muzzle device, such as, for example, a muzzle device 100 or a muzzle device 200, having any desired thread size. Thus, the thread size and/or pitch of the external mounting threads 336 is a design choice based upon the thread size of the device with which the blast shield 300 is to be used. Additionally, it should be appreciated that the threads may be right-hand threads or left-hand threads.

A central borehole 330 extends through the blast shield 300, generally along the longitudinal axis $A_L$ of the blast shield 300. The central borehole 330 has a first central borehole diameter D1 and a restricted portion 332 of the central borehole 330 having a second central borehole diameter D2. The restricted portion 332, typically tapering from the first central borehole diameter D1 to the second central borehole diameter D2 and then from the second central borehole diameter D2 back to the first central borehole diameter D1. By including a restricted portion 332 of the central borehole 330, an area is created such that a Venturi effect to be produced within the central borehole 330.

It should be appreciated that the second central borehole diameter D2 is sufficient to allow the caliber of round with which the blast shield 300 is to be utilized to safely pass through the central borehole 330. Thus, it should be appreciated that the diameters D1 and D2 of the central borehole 330 are a design choice based upon the caliber of weapon or other device with which the blast shield 300 is to be utilized.

In various exemplary, nonlimiting embodiments, the blast shield 300 further includes a series of porting holes or porting apertures 315, some of which are tapered in alternate directions and some of which comprise a constant diameter. The porting apertures 315, if included, allow air to be drawn into the internal cavity 321 of the cup portion 320 as propellant gases exit the muzzle device 300 and are directed forward.

The one or more porting apertures 315 are formed between an outer surface of the body portion 305 and the internal cavity 321 of the cup portion 320. As illustrated, the porting apertures 315 are typically formed so as to provide fluid communication between the exterior of the blast shield 300 (typically through the one or more exterior cup transition walls), the internal cavity 321 of the blast cup portion 320. Thus, the one or more porting apertures 315 allow fluid communication between the internal cavity 321 of the blast cup portion 320 and the outside surface of the blast shield 300.

It should be appreciated that one or more of the porting apertures 315 may have substantially parallel sidewalls and have a substantially cylindrical shape. Alternatively, one or more of the porting apertures 315 may be tapered or reversed tapered, having a more conical shape.

In various exemplary embodiments, one or more borehole apertures 337 are formed between an outer surface of the body portion 305 and the central borehole 330, central to or proximate the restricted portion 332 of the central borehole 330. As illustrated most clearly in FIG. 33, each borehole aperture 337 may optionally be formed at an angle Θ relative to the longitudinal axis $A_L$ of the blast shield 300. In certain exemplary embodiments, each borehole aperture 337 is formed at the same angle Θ relative to the longitudinal axis $A_L$ of the blast shield 300. Alternatively, various borehole apertures 337 may be formed at various angles Θ relative to the longitudinal axis $A_L$ of the blast shield 300.

As illustrated, the borehole apertures 337 have substantially parallel sidewalls and have a substantially cylindrical shape. Alternatively, one or more of the borehole apertures 337 may be tapered or reversed tapered, having a more conical shape.

The borehole apertures 337 are formed so as to allow fluid communication between the exterior of the blast shield 300 (typically within or proximate the attachment portion 310 of the blast shield 300) and the central borehole 330 of the blast cup portion 320. Thus, the one or more borehole apertures 337 allow fluid communication between the central borehole 330 and the outside surface of the blast shield 300.

The inclusion of the borehole apertures 337 provides an increased Venturi effect to draw relatively cooler air in, proximate the restricted portion 332 of the central borehole 330, and mix the relatively cooler intake air with propellant gas. Thus, "extra" air from the exterior of the blast shield 300 can be mixed with the propellant gases as they flow through the central borehole 330.

The overall length, angle, diameter, size, shape, and depth of each borehole aperture 337 is a design choice based upon the desired functionality (i.e. fluid capacity, fluid flow characteristics, etc.) of the blast shield 300.

Thus, during use of the blast shield 300, as a round exits the muzzle of the firearm, the round travels through the central borehole 330 of the blast shield 300. The propellant gases propelling the round enter the central borehole 330 and, utilizing the Venturi effect, pull ambient, outside air through the borehole apertures 337 to mix with the propellant gases.

As the round exits the barrel extension portion 335 of the blast shield 300, the propellant gases continue to move toward the open terminal end 302 of the internal cavity 321 of the cup portion 320 and, utilizing the Venturi effect pull additional, ambient, outside air through the porting apertures 315 formed through the one or more internal cup bottom walls 327. Thus, additional ambient, outside air is mixed with the propellant gases before and as they exit the open terminal end 302 of the internal cavity 321.

Figure 36:
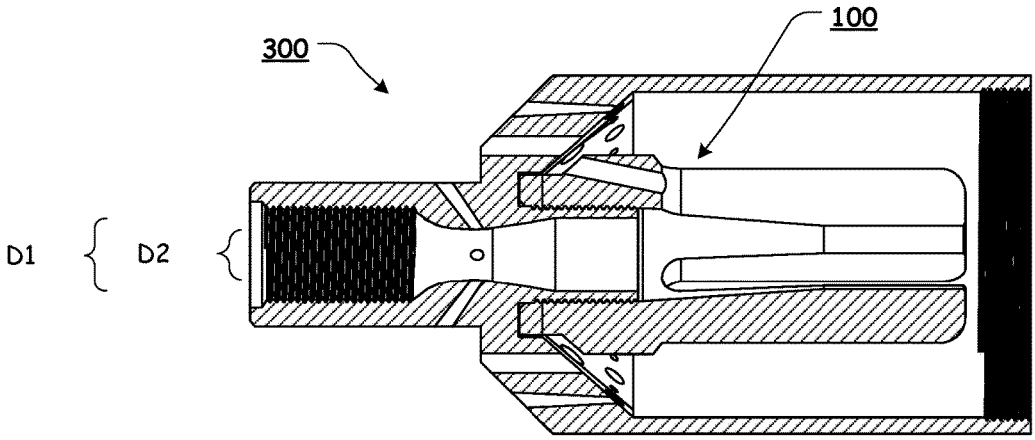
FIG. 36 shows a side cross-sectional view of the blast shield being used in conjunction with an exemplary muzzle device according to the present disclosure.
Figure 37:
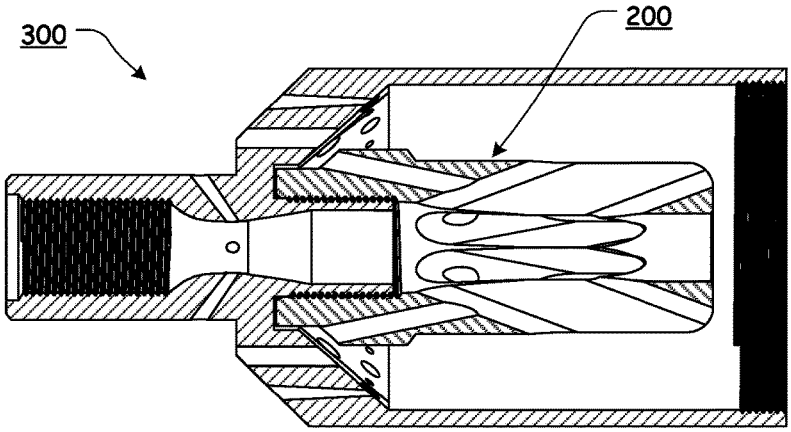
FIG. 37 shows a side cross-sectional view of the blast shield being used in conjunction with an exemplary muzzle device according to the present disclosure.

FIGS. 36 and 37 illustrate an exemplary embodiment of the blast shield 300 utilized in conjunction with various muzzle devices, such as, for example, a muzzle device 100 or a muzzle device 200, as disclosed herein. As illustrated, the muzzle device, such as, for example, the muzzle device 100 or the muzzle device 200 are attached to the barrel extension portion 335. By utilizing one of the disclosed muzzle devices 100 or 200 with the blast shield 300, the porting apertures 315 of the blast shield 300 help to provide outside, ambient air to flow through the porting apertures 115 or 215 of the muzzle devices 100 or 200, respectively.

It should also be appreciated that a more detailed explanation of the muzzle device 100, the muzzle device 200, and blast shield 300, instructions regarding the use and operation of the muzzle device 100, the muzzle device 200, and/or blast shield 300, and certain other items and/or techniques necessary for the implementation and/or operation of the muzzle device 100, the muzzle device 200, and/or blast shield 300 are not provided herein because such background information will be understood by one of ordinary skill in the art.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

Also, it is noted that as used herein and in the appended claims, the singular forms "a", "and", "the", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A muzzle device, comprising:

a body portion extending from an attachment portion to a suppression portion and having a central borehole, wherein said body portion comprises a plurality of prongs defined between longitudinally extending slots formed in said body portion; and one or more porting apertures, wherein each of said porting apertures is formed through a sidewall of one of said longitudinally extending slots, wherein each of said porting apertures provides fluid communication between an exterior of said muzzle device and at least one of said longitudinally extending slots, and wherein each of said porting apertures provides fluid communication between an exterior of said attachment portion and said suppression portion.

2. The muzzle device of claim 1, comprising at least three slots and at least three prongs.

3. The muzzle device of claim 1, comprising at least six slots and at least six prongs.

4. The muzzle device of claim 1, wherein said body portion is adapted to attach to a muzzle end of a firearm barrel.

5. The muzzle device of claim 1, further comprising internal mounting threads, extending from an initial end along at least a portion of said central borehole.

6. The muzzle device of claim 1, wherein a width of each of said at least one longitudinally extending slots is at least partially tapered along a length of said at least one longitudinally extending slot.

7. The muzzle device of claim 1, wherein a width of each of said at least one longitudinally extending slots is consistent along a length of said at least one longitudinally extending slot.

8. The muzzle device of claim 1, wherein each of said porting apertures is formed through said sidewall between adjacent prongs of said plurality of prongs.

9. The muzzle device of claim 1, further comprising at least one collar portion that extends from said body portion and provides a circumferential expansion of said body portion.

10. The muzzle device of claim 9, wherein each of said porting apertures provides fluid communication between an exterior of said muzzle device collar portion and said longitudinally extending slots formed in said body portion.

11. The muzzle device of claim 1, further comprises a crown portion formed so as to join portions of said prongs proximate a terminal end of said muzzle device.

12. A muzzle device, comprising:

a body portion having a central borehole, wherein said body portion extends from an attachment portion to a suppression portion;

a plurality of prongs defined between longitudinally extending slots formed in said suppression portion; and one or more porting apertures, wherein each of said porting apertures is formed through a sidewall of at least one of said longitudinally extending slots, wherein each of said porting apertures provides fluid communication between an exterior of said muzzle device and said central borehole, and wherein each of said porting apertures provides fluid communication between an exterior of said attachment portion and said suppression portion.

13. The muzzle device of claim 12, wherein said attachment portion is adapted to attach to a muzzle end of a firearm barrel.

14. The muzzle device of claim 12, further comprising internal mounting threads, extending from said initial end along at least a portion of said central borehole.

15. The muzzle device of claim 12, further comprises a crown portion formed so as to join portions of said prongs proximate a terminal end of said muzzle device.

* * * * *